US005212462A

United States Patent [19]

Gomez-Henry et al.

[11] Patent Number: 5,212,462

[45] Date of Patent: May 18, 1993

[54] STRIPLINE MICROWAVE MODULE HAVING MEANS FOR CONTACTLESS COUPLING BETWEEN SIGNAL LINES ON DIFFERENT PLANAR LEVELS

[75] Inventors: Michel Gomez-Henry, L'Union; Michel Salvan, Pibrac; Michel Lairle, Villeneuve Tolosane; Gérard Raguenet, Eaunes, all of France

[73] Assignee: Alcatel Espace, Courbevoie, France

[21] Appl. No.: 725,101

[22] Filed: Jul. 3, 1991

[30] Foreign Application Priority Data

Jul. 4, 1990 [FR] France ..... 90 08491

[51] Int. Cl.[5] ..... H01P 5/12

[52] U.S. Cl. ..... 333/136; 333/24 C; 333/246

[58] Field of Search ..... 333/128, 136, 116, 26; 343/769, 789, 786, 700 MS

[56] References Cited

U.S. PATENT DOCUMENTS

| | | | |
|---|---|---|---|
| 3,665,480 | 5/1972 | Fassett | 343/769 X |
| 3,771,075 | 11/1973 | Phelon | 333/246 |
| 3,974,462 | 8/1976 | Fassett | 333/22 R |
| 4,952,895 | 8/1990 | Quan | 333/128 X |
| 5,005,019 | 4/1991 | Zaghloul et al. | 343/700 MS |

FOREIGN PATENT DOCUMENTS

| | | | |
|---|---|---|---|
| 0180011 | 5/1986 | European Pat. Off. . | |
| 843042 | 6/1981 | U.S.S.R. | 333/21 A |
| 8700350 | 1/1987 | World Int. Prop. O. . | |

OTHER PUBLICATIONS

IRE Transactions on Microwave Theory and Techniques, vol. 6, No. 4, Oct. 1958, New York, USA, pp. 403–410; J. K. Shimuzu et al.: "Coupled-transmission--line directional couplers".

IEEE Transactions on Microwave Theory and Techniques, vol. 34, No. 12, Dec. 1986, New York, USA, pp. 1457–1463; E. Yamashita et al.: "Analysis method for generalized suspended striplines".

*Primary Examiner*—Steven Mottola
*Assistant Examiner*—Benny Lee
*Attorney, Agent, or Firm*—Sughrue, Mion, Zinn, Macpeak & Seas

[57] ABSTRACT

The present invention relates to a stripline microwave module comprising: at least one first line situated in a first plane; at least one second line; and at least one coupling opening situated in a second plane so as to enable transmission to take place between the two lines. The invention is particularly suitable for space applications.

13 Claims, 8 Drawing Sheets

STRIPLINE MICROWAVE MODULE HAVING MEANS FOR CONTACTLESS COUPLING BETWEEN SIGNAL LINES ON DIFFERENT PLANAR LEVELS

The invention relates to a stripline microwave module.

BACKGROUND OF THE INVENTION

Stripline mode electromagnetic wave propagation makes use of a set of components performing special functions. These components are then used in the form of assemblies to achieve the design mission:

distributing power to feed radiating elements;

circuitry that takes part in the power stages of a transponder (a generalized coupler matrix for example).

The elementary functions that are implemented most commonly relate to:

power division: defined levels are to be addressed from one arm of a line to various different sub-lines; this may be achieved by means of:

a (compensated or non-compensated) T, which may include more than three branches, and which may be balanced or unbalanced;

by means of ladder circuits having 2, 3, or 4 branches. Here again the design of the component depends on the required intrinsic objectives (division dynamic range, matching, bandwidth); numerous nomagraphs exist in the literature on dimensioning this type of component;

ring circuits, here again a large amount of literature exists (hybrid ring or "rat race" circuit) such that the dimensioning of this type of component is thoroughly mastered or;

changing plane: stripline propagation is established in a plane manner between two parallel ground planes. It is then necessary for reasons of compactness or for interfacing to be able to access the circuit by means of a waveguide or a coaxial mode transition or to be able to cause the energy distributed by the circuit to be radiated by means of a radiating element. Here again a radiating element may be excited by means of a coaxial probe and requires a stripline to coaxial transition.

In a work entitled "Stripline circuit design" by Harlan Howe, Jr. (Microwave Associates, Burlington, Mass. pages 44–49) which deals with interconnections between stripline circuits, one such link is described which may be implemented by means of coaxial connectors lying on the axis of the stripline circuit (FIGS. 2–14) or perpendicular thereto (FIGS. 2–15).

Both of these types of connection suffer from the major drawback of making use of welds that reduce contact reliability.

An object of the present invention is to provide a module making it possible in a single unit and without any mechanical link to perform all or some of the preceding functions:

changing plane;

distributing energy over a determined number of channels.

SUMMARY OF THE INVENTION

To this end, the present invention provides at least one first line situated in a first plane;

at least one second line;

at least one coupling opening situated in a second plane so as to enable transmission to take place between said two lines; the various lines being DC isolated from one another, wherein the module includes a set of cavities made in two conductive blocks disposed on each other and separated from each other by means of a conducting part whose circumference co-operates with the two rims of the two cavities to define the coupling opening.

Advantageously, each line is positioned in one or other of the cavities by means of spacer devices, with each line penetrating into a cavity through a window.

Advantageously, at least one second line is disposed in a third plane such that the coupling opening is situated between the first plane and said third plane.

Such a module makes it possible to avoid any contact when changing propagation mode, e.g. during a stripline-coaxial-stripline transition as required for interconnecting different transmission planes.

Such a module may be used for providing division, phase shifting, or energy distribution functions in stripline mode. It thus makes it possible to build up generalized couplers by using elementary modules that are all identical.

Advantageously, such a module may be used at the outlet from a slot antenna fed directly in stripline mode.

The advantage of such a solution lies in its great simplicity (no adjustments), in the flexibility of its design and of its topology (inputs/outputs), and in its general compactness.

BRIEF DESCRIPTION OF THE DRAWINGS

Embodiments of the invention are described by way of example with reference to the accompanying drawings, in which.

DETAILED DESCRIPTION

Figure 1:
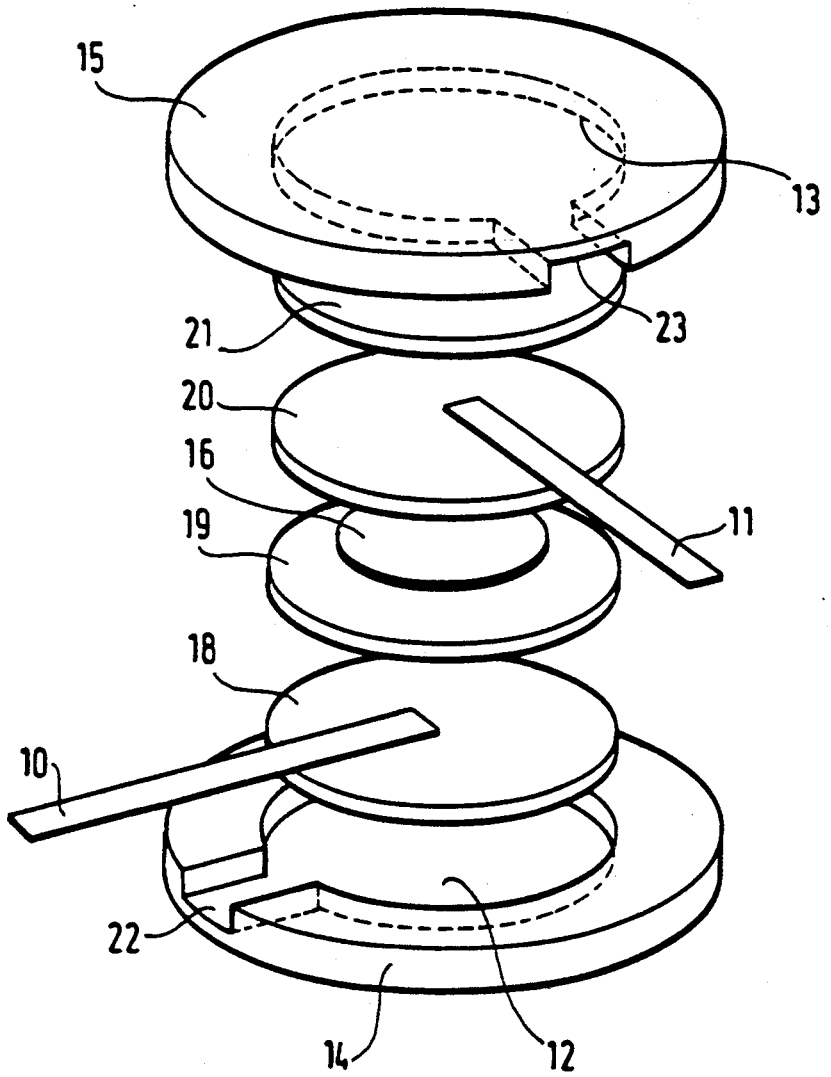
FIGS. 1 to 3 show a first embodiment of a microwave module of the invention respectively as an exploded view, as a perspective view, and as a section view on line III—III of FIG. 2.
Figure 2:
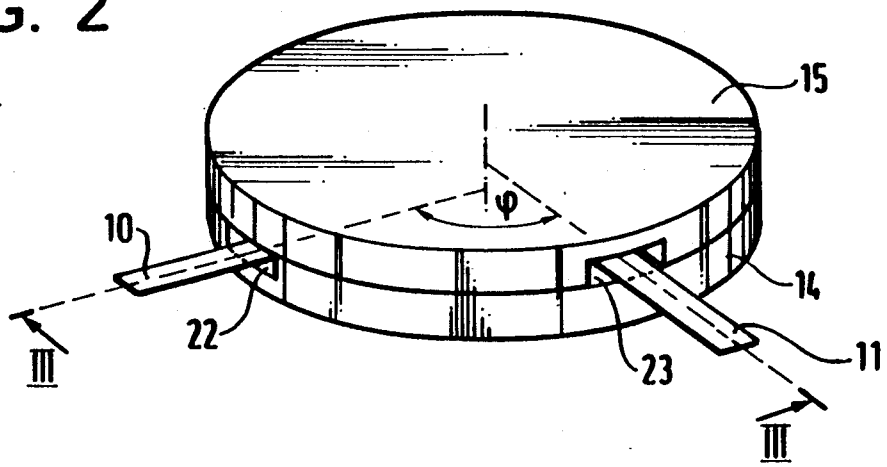
Figure 3:
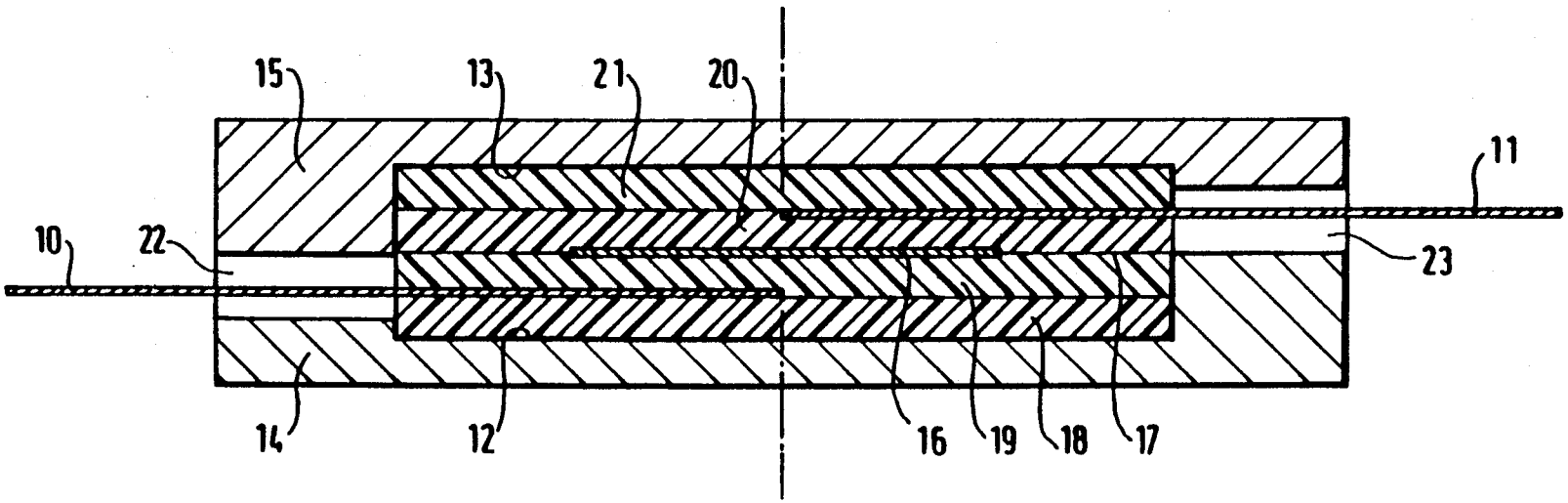

FIGS. 1, 2, and 3 show a microwave module of the invention for changing plane between two striplines 10 and 11 together with an optional change in direction between the striplines 10 and 11, as shown in the figures.

The core of this module is a set of two cavities 12 and 13 which are made in two respective conductive blocks, e.g. metal blocks 14 and 15. The cavities 12 and 13 are placed on each other and they are separated from each other by means of a plane conductive part 16, e.g. a metal disk, having a circumference, which, when associated with the set of rims belonging to the cavities 12 and 13 constitutes a coupling slot 17 for conveying electromagnetic energy from one cavity to the other. Energy transfer thus depends on the geometrical shapes of the cavities 12 and 13 and of the coupling slot 17 (see FIG. 3).

Access to one of the cavities 12 (or 13) is obtained by means of a stripline 10 (or 11). The positioning of this stripline (10 or 11) inside the corresponding cavity is achieved in conventional manner halfway between the ground planes by means of spacer devices 18 and 19 (or 20 and 21) made of dielectric material (see FIGS. 1, 3).

Each stripline (10 or 11) penetrates into the corresponding cavity (12 or 13) through a window (22 or 23) whose geometry is dimensioned in conventional manner for the person skilled in the art to ensure electrical continuity and impedance continuity.

As shown in the section of FIG. 3, the module of the invention includes two levels of stripline circuit. Each stripline circuit is constituted by two ground planes disposed on opposite sides of a conductor line (10, 11) for transferring energy. The central ground plane constituted by the part 16 is common to both levels. The coupling slot 17 thus serves to achieve contactless transmission between the two lines 10 and 11 which are isolated from each other with respect to DC.

It should be observed that the module of the invention can achieve its objects without there being any restrictive conditions:

line impedances and shapes may be arbitrary;

access locations need not necessarily satisfy the known geometrical conditions required by other types of device (ladder coupler or ring coupler); and the cavities 12 and 13 are not necessarily restricted to being circular cylinders and they could well be polyhedral in shape (cubes, rectangular parallelepipeds, pentagonal or hexagonal cylinders, . . . ) which may, for example, simplify the maching of the access windows 22 or 23 to the cavities 12 or 13. Use may be made of discontinuities or of assymetries for special applications (notches, teeth, chamfering, etc., . . . ).

For the plane-changing function in stripline propagation, the cavities 12 and 13 are configured as shown in FIG. 2 and the module of the invention serves to cause electromagnetic energy conveyed by the line 10 in a first plane and in a first direction to pass to the second line 11 which is situated in another plane, with the second line pointing in another direction which makes an angle $\phi$ with the first direction when projected onto the first plane.

By way of example only, one such module may be implemented by using the following dimensions:

diameter of the cavities 12 and 13$\approx$80 mm;

depth of the cavities 12 and 13$\approx$4.3 mm;

width and height of the windows 22 and 23$\approx$20 mm and 6.3 mm;

width of the conductor lines 10 and 11$\approx$9 mm;

thickness of the conductor lines 10 and 11$\approx$0.3 mm:

approximate diameter of the disk 16$\approx$45 mm;

thickness of the disk 16$\approx$0.3 mm.

Figure 4:
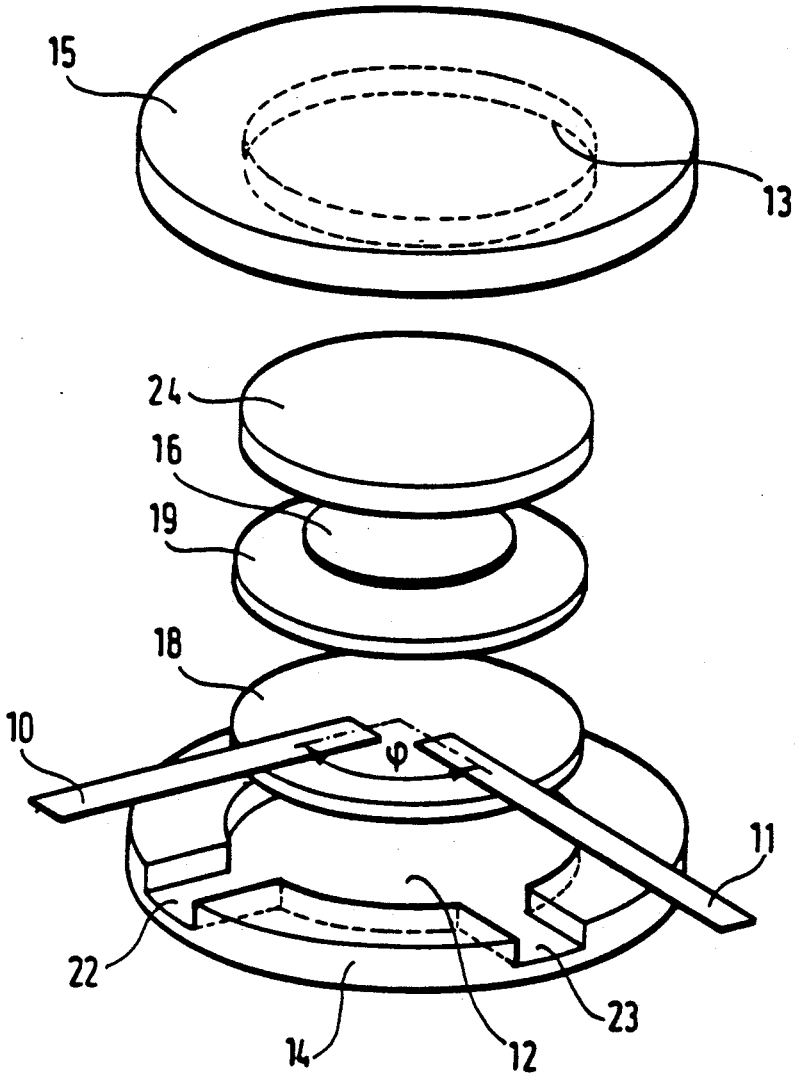
FIGS. 4 to 6 are exploded views of various different variants of the microwave module.

The function of changing propagation direction in a single plane may be obtained by configuring the cavities 12 and 13 as shown in FIG. 4, for example. In this case, the upper cavity 13 is entirely closed and is filled with a spacer dielectric disk 24, e.g. having a thickness of about 6 mm.

The lower cavity 12 is then provided with two access windows 22 and 23 for passing the two conductor lines 10 and 11.

Here again, by controlling the shape of the part 16 it is possible using the module whose geometry is specified above to provide a component for causing electromagnetic energy conveyed by the line 10 to pass to the line 11 situated in the same plane, with the line 11 being at an arbitrary angle $\phi$ relative to the line 10 where $\phi$ lies in the range 30° to 150°. These limit angles are determined by the shapes of the conductors 10 and 11 and also by the volumes required by the access windows 22 and 23. Here again, losses are negligible and for this type of transition they have been measured as being $\leqq$0.05 dB.

Figure 5:
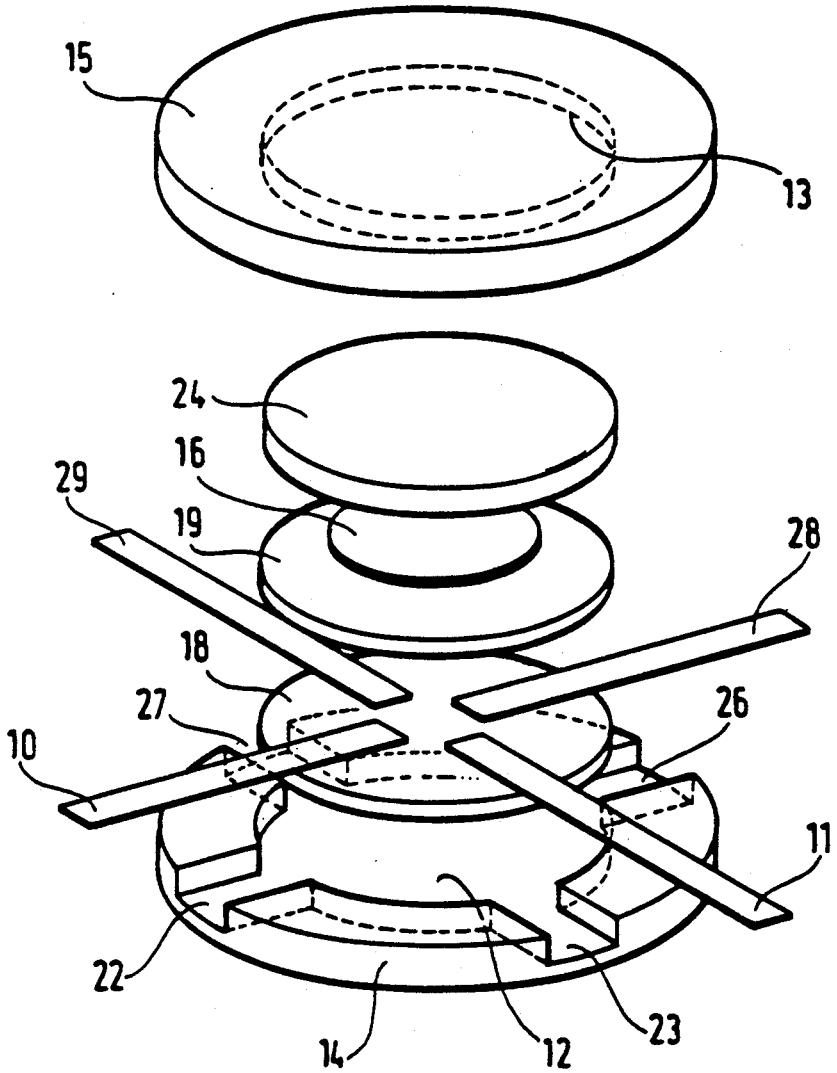

In the configurations shown in FIG. 5, as for the preceding function, the upper cavity 13 is completely closed whereas the lower cavity is provided with four access windows 22, 23, 26, and 27. In such an embodiment, electromagnetic energy conveyed by the line 10 is distributed over the lines 28 and 29, while the line 11 is completely isolated.

As emphasized above, the geometry of the part 16 associated with the shape of the cavity 12 is of major importance. One such architecture makes it possible to achieve arbitrary power distribution:

| | |
|---|---|
| Power division $\alpha$ on channel 29<br>Power division $\beta$ on channel 28 | such that $\alpha^2 + \beta^2 = 1$ |

Typically it is possible to achieve a dynamic range of 10 dB to 15 dB on $\alpha$ or $\beta$, making a module of the invention suitable for use as a directional coupler, with division by two merely constituting a special case.

Special optimizations may also be applied on the output phases. In practice, by appropriately redefining the shapes of the cavities and of the conductors it is possible to achieve the following differences between the paths 28 and 29:

90°: the module behaves like a hybrid junction;

0°: the module behaves like a magic T; or

0°, the module distributes the requested power with integrated phase adjustment.

Flexibility in implementation thus appears to be complete, which shows how significant the possibilities offered by the invention are.

A 3 dB hybrid configuration has been achieved in a concrete example using the following geometrical characteristics:

diameter of the cavities 12 and 13$\approx$80 mm;

depth of the cavities 12 and 13$\approx$6.3 mm;

width and height of the slots 22, 23, 26, and 27$\approx$20 mm and 6.3 mm;

width of the lines 10, 11, 28, and 29$\approx$9 mm;

distances between the ends of the lines 10, 11, 28, and 29 from the center of the circular cavity 12$\approx$10 mm;

thickness of the lines 10, 11, 28, and 29$\approx$0.3 mm;

thickness of the dielectric spacers 18 and 19$\approx$3 mm;

thickness of the dielectric 24$\approx$6 mm;

diameter of the part 16$\approx$45 mm;

thickness of the part 16$\approx$0.3 mm.

With this basic geometry and optimizing the part 16, the following electrical performed were obtained:

matching on any one of the accesses 10, 11, 28, or 29: SWR$\leqq$1.20;

operating bandwidth: 8% 2850/3120 MHz;

power division (28 or 29): $-3$ dB$+0.5$ dB phase shift between the lines 28 and 29: 90°$\pm$0.50°;

isolation of the line 11: 20 dB

Figure 6:
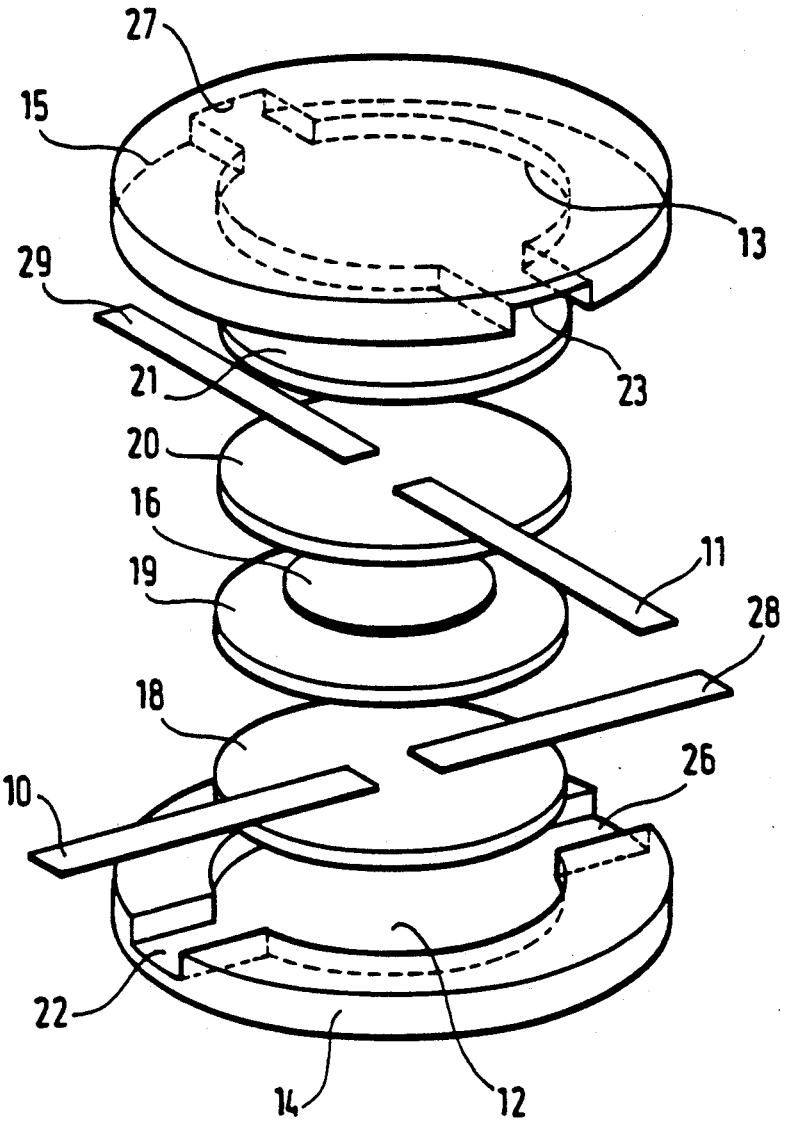

In a variant of the invention shown in FIG. 6, the embodiment of FIG. 1 is combined with the embodiment of FIG. 5. The structural elements common to both FIGS. 5 and 6 have the same reference numerals and the same functions. The upper cavity 13 in FIG. 6 has two diametrically opposed access windows 23 and 27, whereas the lower cavity 12 has two diametrically opposed access windows 22 and 26 which are circumferentially offset by 90° from respective windows 23, 27. The lines 10,28 are colinear and penetrate into the device via the lower access windows 22 and 26, respectively, while the lines 11 and 29 are colinear and penetrate into the device via the upper access windows 23 and 27, respectively. The upper lines 11, 29 are oriented perpendicular to the lower lines 10, 28 as in the case of FIG. 5. The cavities 12 and 13 and the part 16 have geometry similar to that described for FIG. 5. The dielectric parts 18, 19, 20, 21 are similar to those appearing in FIGS. 1 and 5. Starting from FIG. 5, the excitation line 10 and coupled line 28 are situated in the lower plane. The second couple line 29 and the isolated line 11 are situated in the upper plane, thereby making it possible to devise circuit topologies that were unimaginable before, and which can be summarized by:

a high level of function integration; and large capacity.

It is observed that the various lines can be disposed equally well at the lower level or at the higher level and that this can be done without changing the radio frequency (RF). Any configuration thus becomes possible: the line 10 may be at the higher level or at the lower level; the line 11 may be at the higher level or at the lower level; the line 28 may be at the higher level or at the lower level; the line 29 may be at the higher level or at the lower level.

The device shown in FIG. 5 has also been made using eight windows as a variant (not shown) of FIG. 5 an upper window and a lower window for each access regardless of the configuration of the portions. The resulting performance was entirely similar to the configuration shown in FIG. 5, thus underlining the high degree of versatility of this concept.

The geometry of the part 16 is a key feature since it determines the shape of the slot 17. It has thus been optimized carefully.

The following electrical performance has been obtained for one of the above-described modules:

frequency band: 2630 MHz–2970 MHz (12% centered on 2800 MHz);

SWR on the parts 10 and 11 $\leqq 1.20$ over the band;

intrinsic losses of the transition $\leqq 0.05$ dB; and arbitrary angle $\phi$ in the range 0 to $2\pi$, with the angle $\phi$ being selected by appropriately dimensioning the shape of the part 16.

Figure 7:
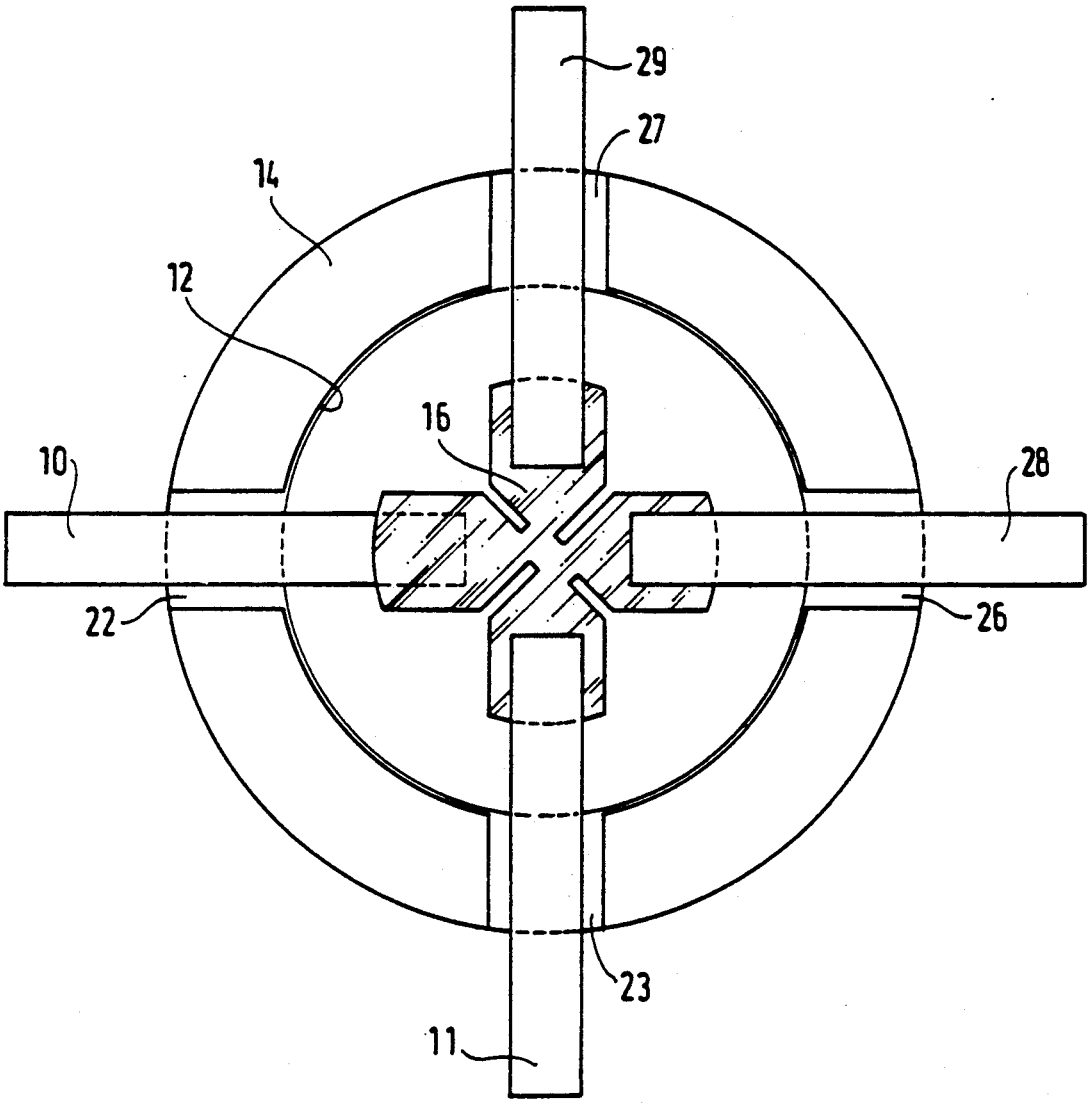
FIG. 7 shows an embodiment of a component of a module of the invention.

FIG. 7 shows another possible shape for the part 16, in this case it is cruciform, in association, for example, with a first line 10 at the lower level and with the other three lines 11, 28, and 29 at the higher level. However, the same operation can be obtained with any combination of levels. Thus in the module of the invention the desired operation is obtained by acting on the shape of the part 16 (disks, cross, notched disk, etc.).

Figure 8:
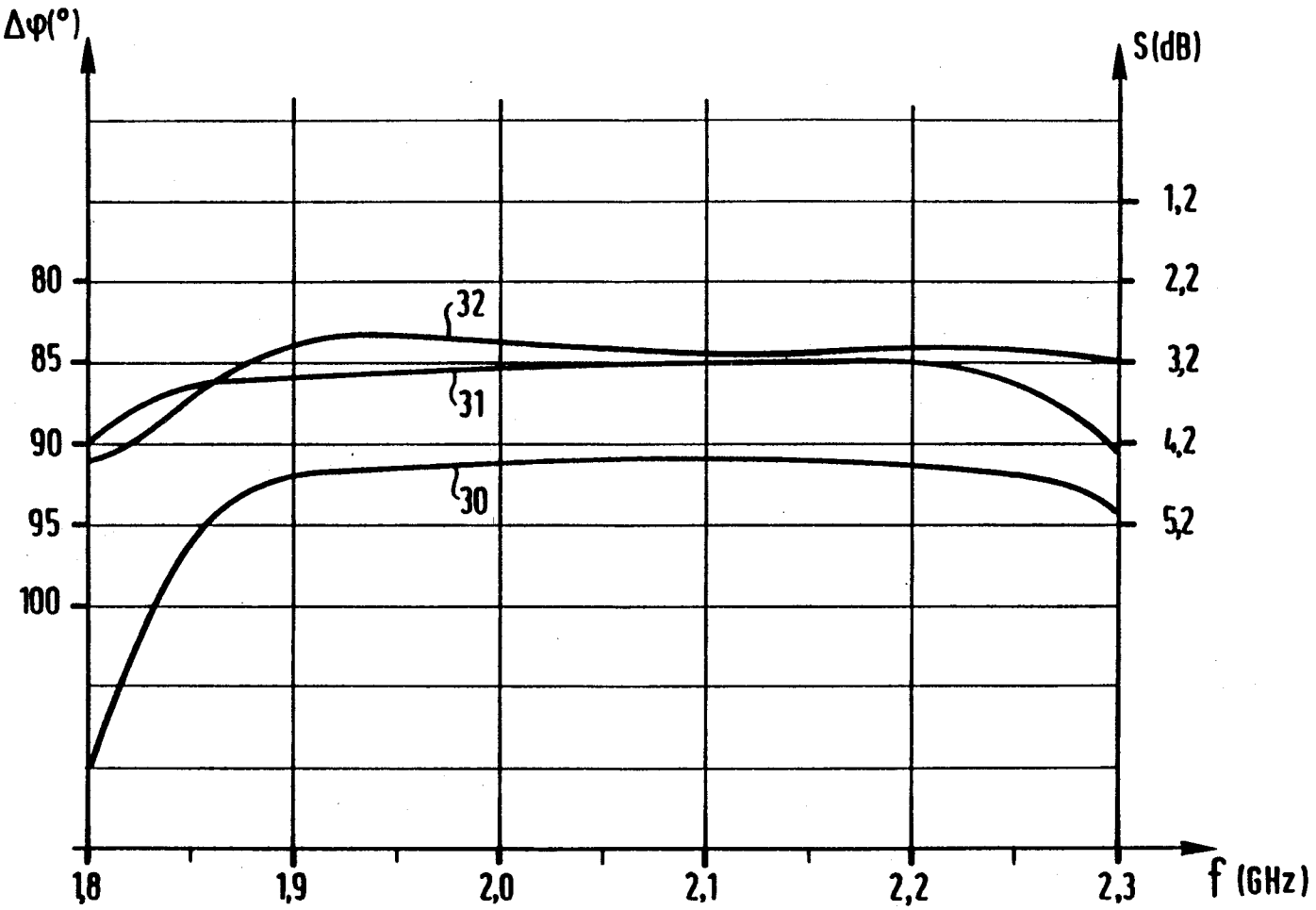
FIG. 8 is a graph showing various operating curves of a module of the invention.

By using the variants of the module of the invention shown in FIGS. 5 and 6 it is possible to achieve a hybrid function. The curves shown in FIG. 8 are then obtained which show the following as a function of frequency f: curve 30 is the phase difference between two accesses, e.g. the lines 28 and 29; while curves 31 and 32 show the power levels S at said accesses, e.g. relative to the line 10.

It can thus be seen that the same operation can be obtained as is obtained using coplanar hybrid circuit while changing plane and without making contact.

It is thus possible to use a module of the invention to the maximum of its possibilities in a first plane (e.g. power division, hybrid junction, etc.) before making any use of its possibilities relating to such a transition between two planes.

Such a module may be applied to a single block made of composite technology by a baking procedure.

The part 16 may be made, for example, by machining, by etching, by metal deposition, etc.

Figure 9:
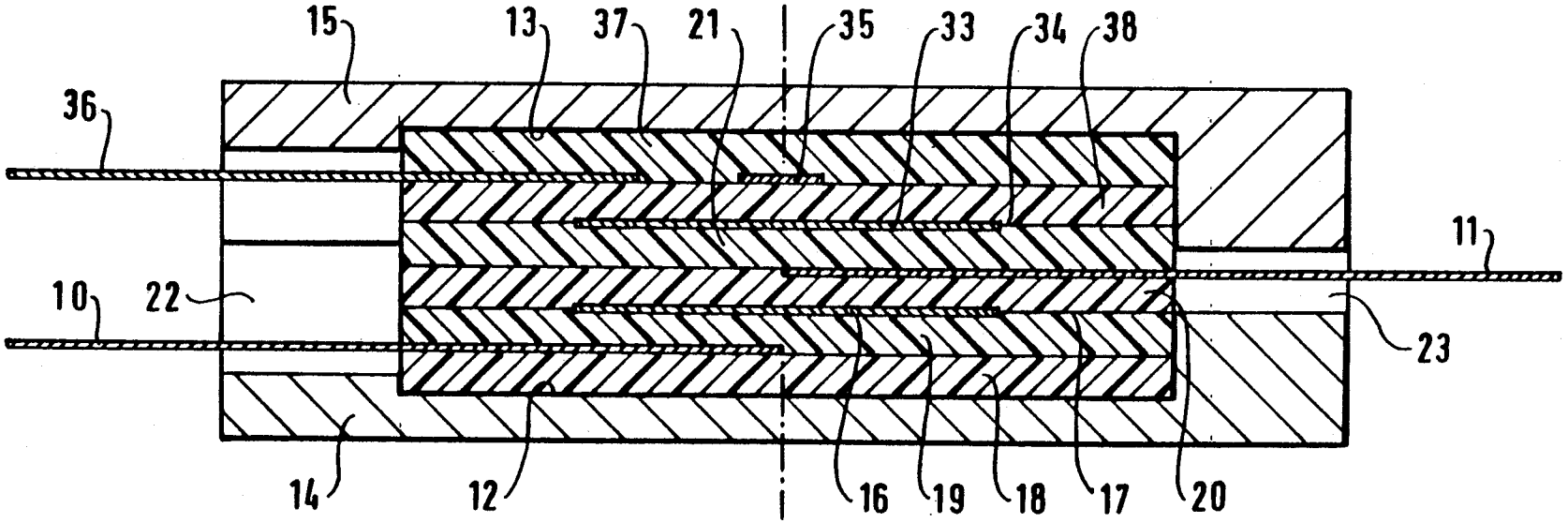
FIG. 9 is a section through a variant embodiment of a microwave module of the invention.

As shown in FIG. 9, it is also possible to consider one (or more) parts 33 analogous to the part 16, thereby making it possible to define one (or more) coupling slots 34 by stacking the parts in a plurality of planes. This makes it possible to obtain a higher number of accesses (in this case additional lines 35 and 36 situated between two spacers 37 and 38), thereby increasing the number of access planes, increasing implantation density, and possibly also increasing the width of the passband.

Naturally the present invention has been described and shown merely by way of preferred example, and its components can be replaced by equivalent parts without thereby going beyond the scope of the invention.

It will thus be possible to use suspended stripline circuits, for example, with the circuits being suspended by rivets and using air as the dielectric.

We claim:

1. A stripline microwave module comprising:

a first conductive line and a second conductive line situated in a first plane;

a coupling opening in a second plane; said second plane being parallel to said first plane and spaced therefrom; said coupling opening enabling microwave contactless coupling between said first line and said second line; said first line and said second line being DC isolated from one another, said module further comprising a set of two cavities, said two cavities being of circular cylindrical geometry and being defined by electrically conducting right cylindrical surfaces; said two right cylindrical surfaces being respectively disposed interiorly within two blocks of electrically conducting material; said circular right cylindrical surfaces having dimensions of internal diameter and height; said two cavities being separated from each other by a flat electrically conducting part situated in said second plane, said flat conducting part having a circular geometry and a diameter and a circumference; and said coupling opening being provided between said two cavities by said diameter of said flat conducting part being less than said internal diameter of said circular cylindrical cavities.

2. A module according to claim 1, wherein said first and second lines are colinear with each other.

3. A module according to claim 1, wherein said first line and second line are spaced from each other around said circumference by an angle $\phi$ of approximately 90°.

4. A module according to claim 1, wherein a third conductive line and a fourth conductive line are situated in said first plane, and wherein said first, second, third and fourth lines are positioned in said one cavity by means of insulative spacer devices, with each line penetrating into said one cavity through a respective window within a respective block, opening from an exterior of said block to said one cavity, and wherein said windows are spaced from each other about said cylindrical surface of said block.

5. A module according to claim 1, wherein the conductive part is of circular disk shape.

6. A module according to claim 1, wherein and second lines are positioned is a respective one of said cavities by means of insulative spacer devices, with each line penetrating into said one cavity through a respective window within said block defining said one cavity with said windows opening from an exterior surface of said block to said one cavity.

7. A stripline microwave module comprising:

at least one first conductive line situated in a first plane;

a coupling opening situated in a second plane;

at least one second conductive line situated in a third plane, said first, said second and said third planes being spaced from and parallel to each other; said coupling opening enabling microwave contactless coupling between said at least one first line and said at at least one second line; said at least one first line and said at least one second line being DC isolated from one another; said module further comprising a set of two cavities, said two cavities being of circular cylindrical geometry and being defined by electrically conducting right cylindrical surfaces; said two right cylindrical surfaces being respectively disposed interiorly within two blocks of electrically conducting material; said circular right cylindrical surfaces having dimensions of internal diameter and height, said two cavities being separated from each other by a flat electrically conducting part situated in said second plane; said flat conducting part having a circular geometry and corresponding dimensions of diameter and at least a partial circumference; and said coupling opening being provided between said two cavities by having said diameter of said flat conducting part less than said internal diameter of said circular cylindrical cavities.

8. A module according to claim 7, further comprising a third conductive line situated in said first plane and spaced around said circumference from said first line, and a fourth conductive line situated in said third plane and spaced around said circumference from said second line, and wherein said third line and said fourth line each penetrates into a respective cavity through a respective window within a respective block opening from an exterior of the block to said respective cavity.

9. A module according to claim 8, wherein said at least one first line and said third line are colinear and spaced from each other, and wherein said at least one second line and said fourth line are colinear and spaced from each other.

10. A module according to claim 7, wherein said at least one first line and said at least one second line are positioned in respective cavities by means of insulative spacer devices, with each line penetrating into a respective cavity through a respective window within a respective block, opening from an exterior of said block to said respective cavity.

11. A stripline microwave module according to claim 10, further comprising a third conductive line and a fourth conductive line situated in said third plane, and spaced around said circumference from each other and said at least one second line, said third and fourth lines being colinear and at right angles to said at least one second line, wherein said at least one first line and said at least one second line are colinear and at right angles to said third and fourth lines, wherein said first, second, third and fourth lines have ends penetrating respective cavities through respective windows within respective first and second blocks, and wherein said conductive part is a circular disk having notches disposed at four spaced locations about said circumference such that said conductive part is of cruciform plan configuration, and wherein the cruciform shaped notched disk includes conductive parts overlapping respectively, ends of said four lines.

12. A stripline microwave module comprising:

two blocks of electrically conducting material;

two cavities of circular cylindrical geometry defined by electrically conductive right angle cylindrical surfaces within respective blocks, having dimensions of internal diameter and height, said cavities facing each other and being separated by a plurality of insulative spacer devices of cylindrical form and forming a stacked array within said two cavities, at least a first conductive line, a second conductive line and a third conductive line separated from each other by respective ones of said insulative spacer devices of said stack and being situated respectively in first, third and fifth planes, a pair of coupling openings situated in a second plane and a fourth plane, all of said planes being parallel and spaced from each other, said coupling openings being situated in said second and fourth planes, and interposed between said first and third planes and said third and fifth planes respectively, said coupling openings enabling microwave contactless coupling between said second line and said third line, said insulative spacer devices maintaining said first, second and third lines DC isolated from one another, and first and second flat electrically conducting parts situated in said second plane and said fourth plane respectively, and said flat conducting parts having a circular geometry and corresponding dimensions of diameter and circumference, said flat conducting parts being positioned within respective cavities of said two conductive blocks and said coupling openings being defined by having the diameter of said flat conducting parts less than said internal diameter of said circular cylindrical cavities.

13. A module according to claim 12, wherein at least said two blocks comprise means for defining windows opening from an exterior of said blocks to said cavities, and said lines penetrate into respective cavities through respective windows.

* * * * *